US006372293B1

(12) United States Patent
Mathus et al.

(10) Patent No.: US 6,372,293 B1
(45) Date of Patent: Apr. 16, 2002

(54) TEST TUBE WITH DATA MATRIX CODE MARKINGS

(75) Inventors: Gregory Mathus, Concord, MA (US); Daniel J. Seguin, Amherst; Victor A. Torti, Brookline, both of NH (US)

(73) Assignee: Matrix Technologies Corporation, Hudson, NH (US)

( * ) Notice: Subject to any disclaimer, the term of this patent is extended or adjusted under 35 U.S.C. 154(b) by 0 days.

(21) Appl. No.: 09/399,405

(22) Filed: Sep. 20, 1999

(51) Int. Cl.[7] ..... B05D 3/00

(52) U.S. Cl. ..... 427/271; 156/239; 235/454; 235/494; 206/459.5; 422/102; 422/915; 427/552; 427/555

(58) Field of Search ..... 235/454, 455, 235/456, 494; 365/12; 346/77 E; 156/60, 349, 384, 272.8, 235, 239, 240; 422/102, 913, 914, 915, 917; 206/459.5

(56) References Cited

U.S. PATENT DOCUMENTS

| | | | | |
|---|---|---|---|---|
| 3,818,188 A | | 6/1974 | Hertel et al. | |
| 4,924,078 A | | 5/1990 | Sant'Anselmo et al. | 235/494 |
| 4,939,354 A | | 7/1990 | Priddy et al. | 235/456 |
| 4,990,792 A | | 2/1991 | Frei | 235/488 |
| 5,357,095 A | | 10/1994 | Weyrauch et al. | 235/494 |
| 5,420,408 A | | 5/1995 | Weyrauch et al. | 235/454 |
| 5,777,303 A | | 7/1998 | Berney | 235/486 |
| 5,985,078 A | * | 11/1999 | Suess et al. | 156/239 |
| 6,214,250 B1 | * | 4/2001 | Moh et al. | 235/494 |

FOREIGN PATENT DOCUMENTS

| | | |
|---|---|---|
| FR | 2266641 | 10/1975 |
| FR | 2649511 | 1/1991 |
| NL | 1003725 | 4/1998 |
| NL | 1003726 | 4/1998 |
| WO | WO89/08264 | 9/1988 |
| WO | WO94/02857 | 2/1994 |
| WO | WO96/07479 | 3/1996 |
| WO | WO96/08433 | 3/1996 |
| WO | WO97/18896 | 5/1997 |
| WO | WO98/05427 | 2/1998 |

* cited by examiner

*Primary Examiner*—Joseph W. Drodge
(74) *Attorney, Agent, or Firm*—Samuels, Gauthier & Stevens

(57) ABSTRACT

A test tube comprises a tube body of unitary construction including an enclosed sidewall and an integral bottom that together define a tubular container having an open top. The bottom has a concave interior surface and a planar exterior surface upon which machine readable data is encoded within a multi-layered opaque coating that is deposited onto the planar exterior surface to uniquely identify the test tube. The machine readable data is preferably an open (i.e., non-proprietary) data matrix code. This code is applied to the test tube by depositing a multi-layer coating onto the planar exterior of the tube bottom. The multi-layer coating may include a first layer of opaque material that is deposited onto the planar exterior surface, and a second layer of opaque material that is deposited onto the first layer. The machine readable code is formed in the multi-layered coating by removing portions of the second layer.

21 Claims, 2 Drawing Sheets

TEST TUBE WITH DATA MATRIX CODE MARKINGS

BACKGROUND OF THE INVENTION

The present invention relates to test tubes, and in particular to test tubes that include machine readable encoded markings to uniquely identify the test tube.

It is known to apply a marking to a test tube to uniquely identify the test tube. For example, PCT Application designated WO 98/05427, published on Feb. 12, 1998 and entitled "*Test Tube With Optically Readable Coding*" discloses a test tube that includes a carrier portion comprising an optically readable coding, such as a dot code. The carrier portion is attached to the bottom of the tubular container, which is the main body of the test tube. For example, this PCT application discloses that the carrier portion may be fixed to the tubular container by a retaining lug or recess, or by being glued, stuck or pressed onto the tubular container.

A problem with this design is that the carrier portion and the tubular container are physically separate devices. In use the carrier may become separated from the tubular container, which defeats the purpose of providing each tube with identification information. In addition, using separate components leads to additional manufacturing costs and complexity.

U.S. Pat. No. 5,777,303 also discloses employing a carrier portion that is affixed to a test tube, and includes an electronic label that comprises an integrated circuit. However, the design disclosed in this patent also has the inherent problem that the carrier portion and tubular portion are physically separate devices.

Therefore, there is a need for an improved test tube that facilitates marking each tube with an identification code uniquely representative of the tube.

SUMMARY OF THE INVENTION

Briefly, according to an aspect of the present invention, a test tube comprises a tube body of unitary construction comprising an enclosed sidewall and an integral bottom surface that together define a tubular container having an open top. The bottom has a concave interior and a planar exterior surface upon which machine readable data is encoded within a multi-layered opaque coating that is deposited onto the planar exterior surface to uniquely identify the test tube.

The machine readable data is preferably an open (i.e., non-proprietary) data matrix code. This code is applied to the test tube by first depositing a multi-layer coating onto the planar exterior of the tube bottom. The multi-layer coating may include a first layer of opaque material that is deposited onto the planar exterior surface, and a second layer of opaque material of a different color that is deposited onto the first layer. The machine readable code is formed in the multi-layered coating by removing portions of the second layer.

In a preferred embodiment, the first and second layers of the multi-layer coating are applied to the exterior surface by thermal transfer (e.g., hot stamping), and select regions of the second layer are removed with a coherent light source (e.g., a laser) to define the machine readable data matrix code.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
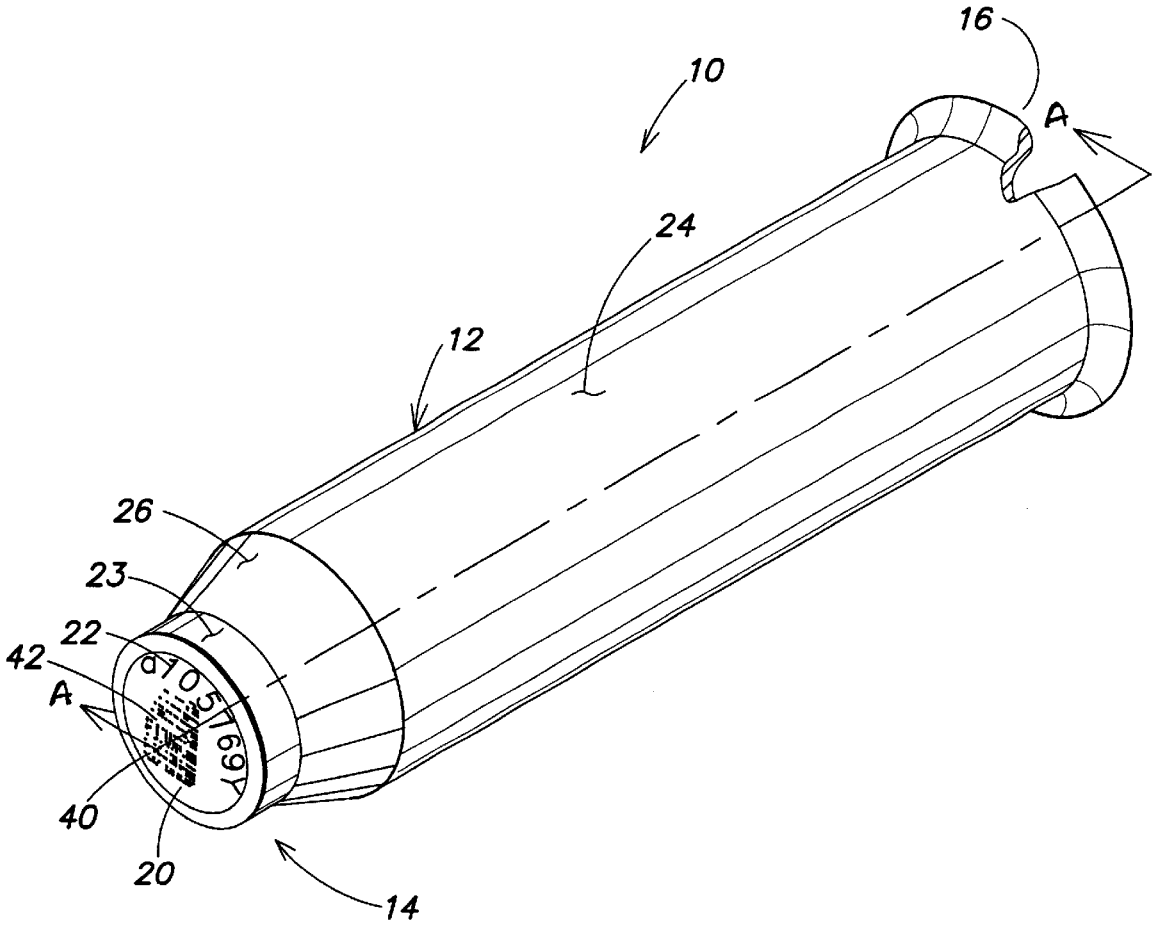
FIG. 1 is a perspective view of a test tube according to the present invention.

FIG. 1 is a perspective view of a test tube 10 according to the present invention. The test tube 10 includes a tube body of unitary construction comprising an enclosed side wall 12 and an integral bottom 14, which together define a tubular container having an open top 16. The tube body is preferably plastic (e.g., polypropylene).

Figure 2:
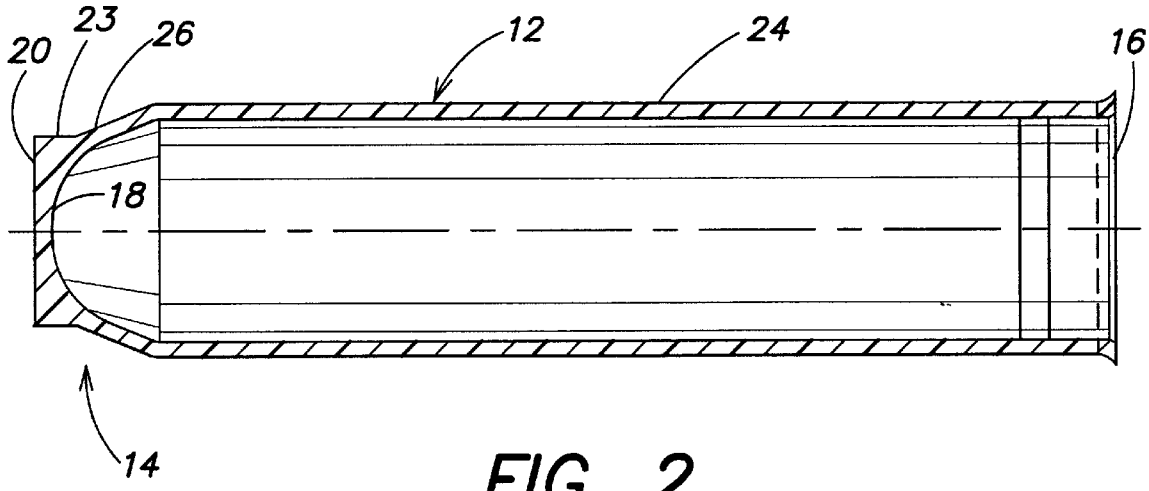
FIG. 2 is a cross-sectional illustration of the test tube of FIG. 1 taken along line A—A of FIG. 1.

FIG. 2 is a cross-sectional illustration of the test tube 10 taken along line A—A in FIG. 1. As shown, the bottom 14 has a shallow concave interior surface 18 and a planar exterior surface 20 upon which machine readable data 21 (FIG. 1) is encoded within an application of opaque multi-layered coatings of contrasting colors (i.e., values) to uniquely identify the test tube. A human readable alphanumeric coding 22 may also be provided around the periphery of the planar exterior surface 20.

Referring to FIGS. 1 and 2, the enclosed side wall 12 includes a plurality of segments having different cross sections. The segments include a first cylindrical sidewall segment 23 integral with the bottom 14 and a second cylindrical sidewall segment 24. The segments also include a truncated conical segment 26 located between the first and second cylindrical sidewall segments 23, 24, and having an increasing diameter closer to the open top 16. Notably, the segments and the bottom form a continuous/unitary structure.

Figure 3:
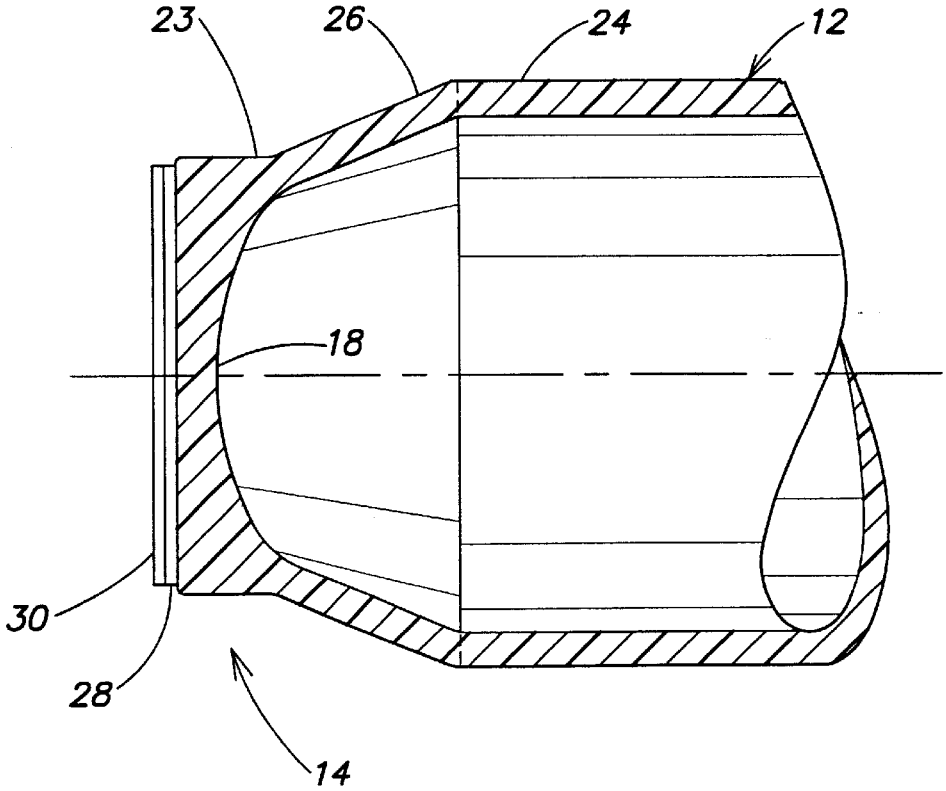
FIG. 3 is a cross-sectional illustration of the bottom portion of the test tube of FIG. 2.

FIG. 3 is an enlarged cross-sectional illustration of the bottom portion of the test tube of FIG. 2. The opaque coating of contrasting colors deposited onto the planar exterior surface 20 is multi-layered. For example, the coating may include a first layer of lighter colored/valued material 28 (e.g., white) and a second layer 30 of darker colored/valued material (e.g., black). In a preferred embodiment the first layer 28 is thermally transferred (e.g., hot stamped) onto the planar exterior surface 20, and the second layer 30 is thermally transferred over the first layer 28. Select portions of the second layer 30 are then removed with a coherent light source (e.g., laser) to define the machine readable data matrix code 21 (FIG. 1). One of ordinary skill will recognize that the thickness of the coatings with respect to the tube sidewall thickness is not to scale, and are presented for ease of illustration.

The first layer 28 may be a conventional white hot stamping foil (i.e., white pigment on a carrier foil), while the second layer 30 may be a black hot stamping foil (i.e., black pigment on a carrier foil). The first and second opaque layers provide contrasting colors. Therefore, when the select portions of the second layer are removed to expose underlying areas of the first layer the machine readable data matrix code is provided.

The hot stamping process may utilize use a heated die that is applied to the product with substantial pressure. In this embodiment the heated due may be set-up with a stamping temperature of about 430° F.–520° F., and a stamping pressure of about 20–80 psi with a dwell time of about 0.5–1.0 seconds. The heated die may be set-up to simultaneously hot stamp a plurality of test tubes (e.g., ninety-six).

Once the first and second layers have been successfully thermally transferred, the coherent light source is used to form the data matrix 21 (FIG. 1). The coherent light source may be a Nd YAG laser. The coherent light source removes select portions of the second layer 30, while leaving the first layer 28 relatively intact to define a machine readable data matrix code. The size of the data matrix may be about 3.0 mm×3.0 mm, and it is preferably an open (i.e., non-proprietary) code. The data matrix is a 2-D bar code that provides billions of encoded numbers.

Referring again to FIG. 1, the select portions of the second layer that have been removed are illustrated as the white areas (e.g., 40–42) within the data matrix code 21.

Machine readable data and/or human readable alphanumeric data may also be placed on the sidewall of the tube. The data machine readable would be encoded within a sidewall opaque multi-layered coating, similar to the multi-layer coating on the planar exterior surface 20 (FIG. 1). The data encoded within the sidewall coating is preferably the same as the data encoded within the layers on the planar exterior surface of the tube. However, the data encoded on the sidewall and the bottom of the tube may certainly be different.

Rather than an opaque multi-layered coatings, it is contemplated that a single coating may also be employed. Specifically, the single layer may be an opaque light colored layer that includes a light sensitive pigment which turns dark when struck by light from, for example, a coherent light source. In this embodiment the laser is used to turn select portions of the single layer coating darker to establish the machine readable data. It is further contemplated that the second layer 30 may be deposited as an optically transparent layer that includes a light sensitive pigment which turns dark (and optically opaque) when struck by light from, for example, a coherent light source. In this embodiment the laser is used to turn select portions of the second layer darker to establish the machine readable data.

Although the method of the present invention has been discussed in a preferred embodiment wherein the first and second layers are deposited separately, it is contemplated that the multiple layers may be superimposed on a common carrier film from which they may be transferred simultaneously in a single hot stamping operation. In addition, one of ordinary skill will recognize that the layers may be deposited by techniques other than hot stamping. For example, alternative techniques for depositing the layers include pad printing, multi-layer offset printing and thermal transfer of silk screened multi-layered pigment on a carrier film. In addition, the coherent light source is clearly not limited to Nd YAG lasers. It is further contemplated that mechanisms other than a laser may be used to remove the select portions of the second layer. The present invention is clearly not limited to the foils disclosed herein. Any opaque coating compatible with the tube material and the selected deposition technique may be used as long as the layers are of contrasting colors.

Although the present invention has been shown and described with respect to several preferred embodiments thereof, various changes, omissions and additions to the form and detail thereof, may be made therein, without departing from the spirit and scope of the invention.

What is claimed is:

1. A test tube, comprising:

a tube body of unitary construction comprising an enclosed sidewall and an integral bottom that together define a tubular container having an open top, wherein said bottom has a concave interior surface and a planar exterior surface upon which machine readable data is encoded within multi-layered opaque coatings of contrasting colors that are deposited onto said planar exterior surface to uniquely identify said test tube.

2. The test tube of claim 1, wherein said multi-layered opaque coating comprises:

a first layer of light colored opaque material deposited onto said planar exterior surface; and a second layer of dark colored opaque material deposited onto said first layer, wherein select portions of said second layer are removed to define a machine readable data matrix code indicative of said test tube.

3. The test tube of claim 1, wherein said sidewall is defined by a plurality of segments having different cross sections, said plurality of segments comprising:

a first cylindrical sidewall segment integral with said bottom;

a second cylindrical sidewall segment; and a truncated conical segment located between said first and second cylindrical sidewall segments and having increasing diameter closer to said open top.

4. The test tube of claim 3, wherein said multi-layered opaque coating comprises:

a first layer of opaque white material deposited on said exterior planar surface; and a second layer of opaque black material deposited on said first layer.

5. The test tube of claim 3, wherein said multi-layered planar coating comprises:

a first layer of white foil deposited on said exterior planar surface; and a second layer of black foil deposited on said first layer.

6. A method of manufacturing a test tube, comprising the steps of:

providing a tube body of unitary construction comprising an enclosed sidewall and an integral bottom that together define a tubular container having an open top, wherein said bottom has a concave interior surface and a planar exterior surface;

depositing a multi-layered opaque coating onto the planar exterior surface to provide a data matrix code that uniquely identifies the test tube, wherein said step of depositing comprises the steps of (i) depositing a first layer of opaque material onto the planar exterior surface;

(ii) depositing a second layer of opaque material onto the first layer, wherein the first layer and the second layer are contrasting colors; and (iii) removing portions of the second layer to define the data matrix code.

7. The method of claim 6, wherein said step of depositing a first layer comprises the step of hot stamping the first layer onto the planar exterior surface.

8. The method of claim 7, wherein said step of depositing a second layer comprises the step of hot stamping the second layer onto the first layer.

9. The method of claim 8, wherein said step of removing portions of the second layer to define the data matrix code comprises the step of applying a coherent light source to remove the portions of the second layer to define the data matrix code.

10. The method of claim 9, wherein the coherent light source is a laser.

11. A method of marking a test tube having a tube body of unitary construction comprising an enclosed sidewall and an integral bottom that together define a tubular container having an open top, wherein the bottom has a concave interior surface and a planar exterior surface, said method of marking comprising the steps of:

depositing a multi-layered opaque coating onto the planar exterior surface to provide a data matrix code that uniquely identifies the test tube, wherein said step of depositing comprises the steps of (i) depositing a first layer of opaque material onto the planar exterior surface;

(ii) depositing a second layer of opaque material over the first layer, wherein the first layer and the second layer are contrasting colors; and (iii) removing portions of the second layer to define the data matrix code.

12. The method of claim 11, wherein said step of depositing a first layer comprises the step of hot stamping the first layer of opaque material onto the planar exterior surface.

13. The method of claim 12, wherein said step of depositing a second layer comprises the step of hot stamping the second layer of opaque material onto the first layer.

14. The method of claim 13, wherein said step of removing portions of the second layer to define the data matrix code comprises the step of applying a coherent light source to remove the portions of the second layer to define the data matrix code.

15. The method of claim 14, wherein said coherent light source is a laser.

16. The method of claim 11, further comprising the step of:

depositing a multi-layered opaque coating onto the enclosed sidewall to provide a second data matrix code that uniquely identifies the test tube.

17. The method of claim 16, wherein said step of depositing a multi-layered opaque coating onto the enclosed sidewall comprises the steps of:

(i) depositing a first sidewall layer of opaque material onto the exterior sidewall;

(ii) depositing a second sidewall layer of opaque material over the first sidewall layer, wherein the first sidewall layer and the second sidewall layer are contrasting colors; and (iii) removing portions of the second sidewall layer to define the second data matrix code.

18. The method of claim 11, further comprising the step of removing portions of the second layer to define a human readable alphanumeric code.

19. The method of claim 11, further comprising the step of removing portions of the second layer to define a human readable alphanumeric code around the periphery of the planar exterior surface.

20. A test tube, comprising:

a cylindrical side wall open at its upper end and closed at its lower end by a bottom wall, said bottom wall having a concave interior surface and a planar exterior surface, wherein said cylindrical side wall and said bottom wall are of unitary construction;

a covering integrally applied to said exterior surface, said covering having a first layer overlying a second layer, said first and second layers being opaque and of contrasting colors; and machine readable data encoded into said covering by selective removal of portions of said first layer in order to expose corresponding underlying portions of said second layer.

21. A test tube, comprising:

a tube body of unitary construction comprising an enclosed sidewall and an integral bottom that together define a tubular container having an open top, wherein said bottom has a concave interior surface and a planar exterior surface upon which machine readable data is encoded within an opaque coating of contrasting colors deposited onto said planar exterior surface to uniquely identify said test tube.

* * * * *